US005660619A

United States Patent [19]

Wachi et al.

[11] Patent Number: 5,660,619

[45] Date of Patent: Aug. 26, 1997

[54] ELECTROLESS GOLD PLATING SOLUTION

[75] Inventors: Hiroshi Wachi, Kanagawa-ken; Yutaka Otani, Hiratsuka, both of Japan

[73] Assignee: Electroplating Engineer of Japan, Limited, Tokyo, Japan

[21] Appl. No.: 691,246

[22] Filed: Aug. 2, 1996

Related U.S. Application Data

[63] Continuation of Ser. No. 514,603, Aug. 14, 1995, Pat. No. 5,614,004.

[51] Int. Cl.[6] ..... C23C 18/52

[52] U.S. Cl. ..... 106/1.23; 106/1.26

[58] Field of Search ..... 106/1.23, 1.26

[56] References Cited

U.S. PATENT DOCUMENTS

| | | | |
|---|---|---|---|
| 3,700,469 | 10/1972 | Okinaka | 106/1 |
| 4,307,136 | 12/1981 | Prost-Tournier et al. | 427/443.1 |
| 4,337,091 | 6/1982 | El-Shazly et al. | 106/1.23 |
| 4,792,469 | 12/1988 | Saito et al. | 427/443.1 |
| 5,035,744 | 7/1991 | Nishiyama et al. | 106/1.23 |
| 5,130,168 | 7/1992 | Mathe et al. | 427/443.1 |
| 5,277,790 | 1/1994 | Morrissey | 205/248 |
| 5,292,361 | 3/1994 | Otsuka et al. | 106/1.28 |
| 5,338,343 | 8/1994 | Kroll et al. | 106/1.23 |
| 5,380,562 | 1/1995 | Hattori et al. | 427/437 |
| 5,560,764 | 10/1996 | Wachi et al. | 106/1.23 |

FOREIGN PATENT DOCUMENTS

| | | |
|---|---|---|
| 52-124428 | 10/1977 | Japan . |
| 55-24914 | 2/1980 | Japan . |
| 56-152958 | 11/1981 | Japan . |
| 59-229478 | 12/1984 | Japan . |
| 60-121274 | 6/1985 | Japan . |
| 62-99477 | 5/1987 | Japan . |
| 3-02471 | 3/1991 | Japan . |

*Primary Examiner*—Helene Klemanski
*Attorney, Agent, or Firm*—Watov & Kipnes, P.C.

[57] ABSTRACT

The present invention provides an electroless gold plating solution which does not precipitate gold at high concentrations of thallium or lead compound, while retaining its effects such as increased deposition rate and larger crystallite sizes in the deposited layer. The electroless gold plating solution according to the invention contains 0.1–10 g/l of a chelating agent, such as diethylenetriaminepentaacetic acid (DTPA), ethylenediaminetetraacetic acid or nitrilotriacetic acid, DTPA being a preferable agent.

4 Claims, No Drawings

ELECTROLESS GOLD PLATING SOLUTION

This is a continuation of application Ser. No. 08/514,603, filed Aug. 14, 1995 now U.S. Pat. No. 5,614,004.

BACKGROUND OF THE INVENTION (1) Field of the Invention

The invention relates to an electroless gold plating solution, particularly a solution capable of plating exactly onto predetermined parts on the workpiece.

(2) Description of the Prior Art

Electroless gold plating solution containing a thallium or lead compound are known, as disclosed, for example, in JP 56/152958, which increases the deposition rate of gold, and helps crystal growth in the deposit and thus enhances the heat resistance of the latter.

However, such a compound tends to decompose the solution and cause gold precipitate at high concentrations. Therefore, the concentration should be limited to several ppm at the highest, which renders the solution very difficult in handling.

The present invention aims at elimination of this problem associated with such plating solutions, and provides an electroless gold plating solution which does not deliver gold precipitation even at high concentration of said thallium or lead compound, while retaining its advantages such as increased deposition rate and large crystallites of deposits.

SUMMARY OF THE INVENTION

The electroless gold plating solution according to the invention contains 0.1–10 g/l, or preferably 0.5–2 g/l, of a chelating agent for the purpose stated above. The chelating agent does not effectively control gold precipitation at concentrations less than 0.1 g/l, while it reduces the deposition rate at concentrations higher than 10 g/l.

Any chelating agent, such as diethylenetriaminepentaacetic acid (DTPA hereinafter), ethylenediaminetetraacetic acid, or nitrilotriacetic acid, can be used, the first being a preferable agent.

Such a chelating agent as complexing agent prevents precipitation of gold even at high concentrations of the thallium or lead compound mentioned above, thus allowing addition of a less restricted amount of such a metal compound to the plating solution.

The electroless gold plating solution according to the invention contains gold in a form of an alkali metal gold cyanide, such as potassium gold cyanide or sodium gold cyanide, the former being the preferred form. A preferable concentration range of gold is 0.5–8 g/l as Au.

The thallium compound to be added will preferably be thallium formate, thallium sulfate, thallium oxide, thallium malonate, or thallium chloride. Thallium formate is particularly convenient because of a toxicity lower than thallium sulfate and other compounds.

The preferable lead compounds are lead citrate, lead acetate and lead oxide.

The amount added of such a compound is chosen so that the concentration of the metal is 0.1–50 ppm, at which no precipitation of gold occurs.

As the reducing agent are used boron-based substances, such as dimethylamineborane, boron potassium hydride, or boron sodium hydride. A preferable concentration range of the reducing agent is 1–30 g/l.

The electroless gold plating solution according to the invention may, in addition, contain an alkali metal cyanide, specifically sodium cyanide or potassium cyanide, when the stability of the self-catalyzing process is especially needed. A preferable concentration range of such a cyanide is 0.1–10 g/l.

The electroless gold plating solution according to the invention may further contain 5–500 mg/l of sodium nitrobenzensulfonate or p-nitrobenzoic acid. Addition of such an oxidant controls the action of the reducing agent to reduce further unwanted spread of plated areas, without lowering the deposition rate excessively.

The plating solution may further contain 2–20 g/l of dimethylamine as one of amine group, which, with its low boiling point, is only weakly adsorbed onto the plating site, and thus prevents unwanted spread of electroless gold plating solution outside predetermined parts to be plated, while retaining the characteristics of amines to maintain the deposition rate and prevent decomposition of the solution.

The pH value of the solution should preferably be kept in a range from 11 to 14. An alkali metal hydroxide, such as sodium hydroxide or potassium hydroxide is a PH adjustive solution to maintain such PH level.

Plating operations using the solution should preferably performed at a temperature of 50°–80° C.

The compositions in the electroless gold plating solution according to the invention can be combined in manners as indicated below as [A] through [J].

[A] An electroless gold plating solution containing a gold alkaline metal cyanide, a boron-based reducing agent, an alkali metal hydroxide as a pH controller, and a thallium and/or lead compound, wherein 0.1 to 10 g/l of a chelating agent is added to the electroless gold plating solution.

[B] An electroless gold plating solution as defined in the above [A] wherein the chelating agent is at least one of diethylen etriaminepentaacetic acid, ethylenediaminetetraacetic acid, and nitrilotriacetic acid.

[C] An electroless gold plating solution as defined in the above [A] or [B] wherein the concentration of thallium compound and/or lead compound is 0.1 to 50 ppm as metals.

[D] An electroless gold plating solution as defined in any of the above [A] to [C] wherein the thallium compound is at least one of thallium formate, thallium sulfate, thallium oxide, thallium malonate and thallium chloride.

[E] An electroless gold plating solution as defined in any of the above [A] to [D] wherein the lead compound is at least one of lead citrate, lead acetate and lead oxide.

[F] An electroless gold plating solution as defined in any of the above [A] to [E] wherein the boron-based reducing agent is at least one of dimethylamineborane, boron potassium hydride, and boron sodium hydride.

[G] An electroless gold plating solution as defined in any of the above [I] to [F] wherein the concentration of the reducing agent is 1 to 30 g/l.

[H] An electroless gold plating solution as defined in any of the above [A] to [G], which has a pH value of 11 to 14.

[I] An electroless gold plating solution as defined in any of the above [A] to [H], wherein 5 to 500 mg/l of sodium nitrobenzenesulfonate and/or p-nitrobenzoic acid are/is added.

[J] An electroless gold plating solution as defined in any of the above [A] to [I], wherein 2 to 20 g/l of dimethylamine is added.

It should be noted that the content of the invention is not limited to the above description, and the objects, advantages, features, and usages will become more apparent according to descriptions below. It is also to be understood that any appropriate changes without departing from the spirit of the invention are in the scope of the invention.

DETAILED DESCRIPTION OF THE PREFERRED EMBODIMENTS

Embodiments of the present invention will be described hereinafter.

TABLE 1

| | |
|---|---|
| Gold potassium cyanide | 4 g/l as gold |
| Dimethylamineborane | 8 g/l |
| Potassium hydroxide | 35 g/l |
| Potassium cyanide | 3 g/l |

TABLE 2

| | |
|---|---|
| Temperature | 70° C. |
| pH | 14 |
| Plating time | 30 min. |

Various amounts of thallium formate and the chelating agent DTPA were added to an electroless gold plating solution of the composition presented above prepared using reagents of special grade. While the amounts of thallium formate and DTPA,are changed with respect to each other, gold precipitation was checked and deposition rate was evaluated. The plating was performed until the thickness of the deposited layer reached 2 μm, and the deposition rates were measured. Deposits obtained had a uniform lemon-yellow color and presented no problem in the appearance.

TABLE 3

| No. | | Thallium (ppm) | DTPA additives (g/l) | Evaluation | Deposition rate (μm/hr) |
|---|---|---|---|---|---|
| Examples | 1 | 50.0 | 10 | o | 3 |
| | 2 | 10.0 | 2 | o | 5 |
| | 3 | 2.0 | 2 | o | 3 |
| | 4 | 1.0 | 2 | o | 3 |
| | 5 | 0.1 | 0.1 | o | 3 |
| Comparative Examples | 6 | 50.0 | — | x | — |
| | 7 | 10.0 | — | x | — |
| | 8 | 2.0 | — | x | — |
| | 9 | 1.0 | — | x | — |
| | 10 | 0.1 | — | o | 3 |

Evaluation
o: No gold precipitation is observed.
x: Gold precipitation is observed.

The results shown in Table 3 indicate that the solution containing DTPA of the concentration stated earlier did not precipitate gold at thallium concentrations up to 50 ppm, while solutions without DTPA decomposed and precipitated gold at a thallium concentration as low as 1.0 ppm (see Reference Example 9). Addition of DTPA did not decrease the deposition rate. In summary, DTPA allows addition of thallium at concentration as high as 0.1–50 ppm without gold precipitation, while thallium concentration cannot exceed 0.1 ppm in conventional formulations as illustrated by Reference Example 10.

TABLE 4

| | |
|---|---|
| Gold potassium cyanide | 4 g/l as gold |
| Boron potassium hydride | 20 g/l |
| Potassium hydroxide | 10 g/l |
| Potassium cyanide | 2 g/l |
| Lead citrate | 0.1–50 ppm as lead |

TABLE 5

| | |
|---|---|
| Temperature | 70° C. |
| pH | 13 |
| Plating time | 30 min. |

In this example where boron potassium hydride was used as the reducing agent and lead was added instead of thallium, addition of 0.1–10 g/l of DTPA led to results similar to those in Example 1 above.

The electroless gold plating solution according to the invention, as described above, does not precipitate gold at high concentrations of thallium or lead compound, while retaining its effects such as increased deposition rate and larger crystallite sizes in the deposited layer, thus facilitating the handling of the solution and the plating operation.

What is claimed is:

1. An electroless gold plating solution containing a gold alkali metal cyanide, a boron-based reducing agent, an alkali metal hydroxide as a pH controller, and a lead compound, wherein 0.1 to 10 g/l of a chelating agent and 5 to 99 mg/l of sodium nitrobenzenesulfonate or p-nitrobenzoic acid, or mixtures thereof are added, whereby the sodium nitrobenzenesulfonate or p-nitrobenzoic acid is added as an oxidant to control the action of said reducing agent to reduce undesirable spread of plated areas.

2. An electroless gold plating solution as defined in claim 1, wherein the chelating agent is selected from the group consisting of diethylenetriaminepentaacetic acid, ethylenediaminetetraacetic acid, and nitrilotriacetic acid.

3. An electroless gold plating solution as defined in claim 1, wherein the concentration of lead compound is 0.1 to 50 ppm.

4. An electroless gold plating solution as defined in claim 1, wherein the lead compound is selected from the group consisting of lead citrate, lead acetate and lead oxide.

* * * * *